United States Patent [19]

Ottow et al.

[11] 4,426,401

[45] Jan. 17, 1984

[54] FOOD PROCESS

[75] Inventors: Alexander B. Ottow, Rotterdam-Schiebroek; Arthur Stiegeler, Dietmannsride; Jan Tjaden, Durach, all of Fed. Rep. of Germany

[73] Assignee: Internationale Octrooi Maatschappij "Octropa" B.V., Rotterdam, Netherlands

[21] Appl. No.: 331,387

[22] Filed: Dec. 16, 1981

Related U.S. Application Data

[63] Continuation of Ser. No. 153,239, May 27, 1980, abandoned, which is a continuation of Ser. No. 55,843, Jul. 9, 1979, abandoned, which is a continuation-in-part of Ser. No. 945,768, Sep. 25, 1978, abandoned, which is a continuation of Ser. No. 787,656, Apr. 14, 1977, abandoned, which is a continuation of Ser. No. 676,562, Apr. 13, 1976, abandoned.

[30] Foreign Application Priority Data

Apr. 14, 1975 [LU] Luxembourg ..... 72277

[51] Int. Cl.[3] ..... A21D 8/06; A23L 3/10; B65B 29/08

[52] U.S. Cl. ..... 426/394; 426/395; 426/396; 426/403; 426/412; 426/113; 426/128; 426/496; 426/505; 229/DIG. 14; 53/440; 220/366

[58] Field of Search ..... 426/118, 128, 412, 113, 426/399, 234, 396, 106, 127, 131, 393, 407, 395, 403, 496, 505; 229/DIG. 14; 53/440; 220/366

[56] References Cited

U.S. PATENT DOCUMENTS

| | | | |
|---|---|---|---|
| 1,081,945 | 12/1913 | Bitter | 426/415 |
| 2,361,344 | 10/1944 | Yates | 426/118 |
| 2,595,708 | 5/1952 | Salfisberg | 426/118 |
| 2,633,284 | 3/1953 | Moffett et al. | 426/118 |
| 2,858,220 | 10/1958 | Battiste | 426/128 |
| 2,963,375 | 12/1960 | Allen | 426/412 |
| 3,012,895 | 12/1961 | Stelnicki | 426/113 |
| 3,097,787 | 7/1963 | Schur | 426/118 |
| 3,185,579 | 5/1965 | Dehne | 426/412 |
| 3,193,389 | 7/1965 | Dehne | 426/128 |
| 3,399,822 | 9/1968 | Kugler | 426/118 |
| 3,432,087 | 3/1969 | Costello | 426/118 |
| 3,502,487 | 3/1970 | Byrd | 426/118 |
| 3,542,568 | 11/1970 | Bouyer | 426/128 |
| 3,672,915 | 6/1972 | Wiggins | 426/118 |
| 3,765,907 | 10/1973 | Killoran | 426/127 |
| 3,767,422 | 10/1973 | Levitz | 426/523 |
| 3,873,735 | 3/1975 | Chalin et al. | 426/118 |
| 3,875,318 | 4/1975 | Davies | 426/399 |
| 3,891,775 | 6/1975 | Murray et al. | 426/113 |
| 3,914,445 | 10/1975 | Pavey | 426/331 |
| 3,937,396 | 2/1976 | Schneider | 426/118 |
| 3,946,780 | 3/1976 | Sellers | 426/118 |
| 3,997,677 | 12/1976 | Hirsch et al. | 426/118 |
| 4,120,984 | 10/1978 | Richardson et al. | 426/396 |

FOREIGN PATENT DOCUMENTS

| | | | |
|---|---|---|---|
| 2307723 | 12/1976 | France | 426/412 |
| 50-30704 | 10/1975 | Japan | 426/412 |
| 51-57862 | 5/1976 | Japan | 426/412 |
| 953523 | 3/1964 | United Kingdom | 426/128 |
| 1008679 | 11/1965 | United Kingdom | 426/128 |
| 1271892 | 4/1972 | United Kingdom | 426/128 |

OTHER PUBLICATIONS

Transactions of Amer. Assoc. of Cereal Chemists, vol. 8, #2, 8/50, pp. 107–112.
Modern Packaging, 10/49, p. 106.
Food Manufacture, 12/59, p. 493.
Modern Plastics, 4/68, pp. 93–96.

*Primary Examiner*—Steven L. Weinstein
*Attorney, Agent, or Firm*—Cushman, Darby & Cushman

[57] ABSTRACT

Perishable goods containing water, especially foodstuffs, are packed aseptically in packages formed from impervious but flexible film and furnished with vents adequate for the escape of vapor during treatment at bake or part-bake temperatures at which goods in the package are pasteurized, the vents remaining open throughout the heating and subsequent cooling thereafter to prevent the package collapsing on the goods. The vents are positioned for security of subsequent closure in a closure seam first made to enclose the goods in the package and are constituted by interruptions in the seam providing a total cross-sectional venting area of more than 2.5 $mms^2$. The vents are sealed after cooling. The invention is particularly applicable to the packaging of bakers' goods which are baked or part-baked in the package, which is preferably made from laminated polymeric film material. Preferably the vents, at least two in number, extend through a seam sealing a lid to a container forming the package, the seam being interrupted to provide the vents, by forming the seam over spacing members which are either subsequently withdrawn or are tubular to provide the vents.

1 Claim, No Drawings

FOOD PROCESS

This is a continuation of abandoned application Ser. No. 153,239, filed May 27, 1980, which is a continuation of abandoned application Ser. No. 55,843, filed July 9, 1979 as a continuation-in-part of abandoned Ser. No. 945,768, filed Sept. 25, 1978, the latter being a continuation of abandoned Ser. No. 787,656, filed Apr. 14, 1977, as a continuation of abandoned Ser. No. 676,562, filed Apr. 13, 1976.

BACKGROUND OF THE INVENTION

1. Field of the Invention

The present invention relates to a process for aseptically packing water-containing products, which are subjected to a heat treatment in the package.

In the aseptic packaging of foodstuffs such as e.g. bread, and other water-containing products which are heat-treated in the package to effect decontamination, the principal and most obvious problem is to avoid in film packages recontamination when the heated package is cooled down. Provision must be made to release gas generated during the heating step to avoid the package bursting or expanding unduly, and packaging material may be chosen for this purpose which is pervious to gas and water vapour during the heating operation. Alternatively, valve means may be fitted to otherwise impervious packages which opens during the heating step. Whatever means are adopted, condensation and/or contraction of vapour remaining in the package may lead to the package collapsing on its contents and will in any case tend, as soon as a leak develops, to contaminate the contents of the package by sucking in airborne infective micro-organisms. If, on the other hand, air is deliberately admitted during the cooling step to equalise the pressure inside and outside the package, then the danger of infection again occurs. Hitherto it has appeared that simple discrete vents remaining open during both the heating and cooling steps could not be adopted for these reasons.

The present invention is based upon the discovery that the security of the sealed package is ensured if the vents are installed as interruptions in a seam first made in the package to enclose the goods therein.

2. Prior Art

In British Pat. No. 852,946 a bag is described made from plastic material impervious to water and oxygen which is provided with overlapping lips to close the bag hermetically under normal storage but to open under internal pressure generated by the release of carbon dioxide, preventing the bag from bursting when yeast is stored in it.

British Pat. No. 887,215 describes a bag furnished with a thread extending through two heat-sealed positions to provide vents which will release pressure generated when the bag is heated. A container lid for a cup or carton is described in British Pat. No. 917,998, having vent opening means through the lid covered with vapour-pervious sheet material to allow steam to escape from the container while retaining potable liquids held in the container. A different arrangement for similar containers is described in British Pat. No. 934,067, a sanitary seal being provided between the lid and the container, the parts of which open under excess pressure generated within the container to release gas therefrom. In British Pat. No. 951,228 an interrupted seal is formed across the opening of a plastics bag which is small enough to retain granular solids and similar small articles, while permitting air to be expelled from the bag to improve the pallet stability of the filled bag or sack.

In British Pat. No. 961,821 a packaging film is described which is embossed to provide raised portions. These are pierced to permit the passage of gas.

The ingress of bacteria into packages is prevented according to British Pat. No. 1,006,678 by means of a backing layer made for example of paper on a synthetic resin such as polyethylene, the packing omitting the permeation of oxygen. In British Pat. No. 1,021,596 a container is fitted with a snap-on closure forming an annular seal which is temporarily broken when pressure is generated in the container so that gases may escape via flutes in the upper side wall of the container. In British Pat. No. 1,106,747 a film of shrink-type material covering paper or plastics receptacles is punctured by needles to permit escape of gases. According to British Pat. No. 1,192,751, small perforations are provided in a metal foil package permitting the escape of gases from inside the package but being too small to permit atmospheric oxygen to enter.

In none of the arrangements described in the prior art is reliance placed upon seam vents remaining open during the cooling period after heating containers to sterilise their contents.

The packaging of bread is described in British Pat. No. 1,008,679, according to which it is wrapped while still hot from the oven in a material which becomes impervious to water below 25° C. According to British Pat. No. 1,197,130, a channel is left between adjacent packs used to package bread which permits the escape of gases during sterilisation by heat treatment, the channel being sealed when the packaging operation is completed.

In most of the prior art disclosure is confined either to temporary passageways which are sealed in the final packaging operation, or which use comparatively porous material. Packages intended to prevent the ingress of bacteria are confined, as in British Pat. No. 1,006,678, to the use of porous film rather than vent orifices. Those disclosures of small vents are confined to holes through the thickness of film material.

DESCRIPTION OF THE INVENTION

The shelf-life of foodstuffs such as bread and other water-containing perishable products may be prolonged by pasteurisation or sterilisation effected by heat treatment associated with baking the products, carried out in containers in which the products are sealed and subsequently stored. Where the container is constructed from flexible sheet material such as foil or plastic film, provision must be made to avoid deforming it during both the heating and subsequent cooling. On heating it may expand or rupture by expansion or formation of gases and vapours inside it, whereas on subsequently cooling it may collapse on the goods. Provision must therefore be made to release gas pressure generated during the heating step to avoid the package bursting or expanding unduly, and packaging material may be chosen for this purpose which is pervious to gas and water vapour during the heating operation. Alternatively, valve means may be fitted to otherwise impervious packages which opens during the heating step. Whatever means are adopted to prevent deformation during heating, condensation and/or contraction of vapour remaining in the container may lead to its collapsing on its contents and will in any case tend, as soon as a leak develops, to contaminate the contents of the container by sucking in airborne infective micro-organisms capable of re-inoculating the goods. If, on the other hand, air is deliberately admitted during the cooling step to equalise substantially instantaneously the pressure inside and outside the container, then the danger of re-inoculation again occurs both on cooling and after final sealing unless this is effective to prevent the development of leaks.

The present invention is based upon the discovery that the security of the sealed package is ensured if the vents are installed as interruptions in the seam first made to enclose the goods in the package.

No significant under-pressure develops in the package as a result, whereas decontamination within the package obtained by the heat treatment is substantially maintained.

The invention therefore provides a process for the preparation of baked or part-baked goods of improved shelf-life, packed in a package constructed essentially from flexible film material impervious to infective micro-organisms, comprising baking or part-baking and subsequently cooling the goods in the package, the said package including vent means providing a total cross-sectional venting area of more than 2.5 $mms^2$ whereby the package is neither ruptured nor unduly distorted by the generation and expansion or contraction of gases in the package at that time, promptly thereafter closing said vents to seal the baked or part-baked goods in the package, the vent means consisting essentially of interruptions in a closure seam first made in the package to enclose the goods therein whereby the security of subsequent closure of the package is ensured.

Preferably the vents are straight and in any case not labyrinthine or tortuous. Further, they should be discrete, i.e. separately formed, as distinct from channels in a wadding filter. There are preferably at least 2 but not more than 20, although the upper limit is not critical. In general there are preferably 2 to 10, more particularly 2 to 6. Generally the width of the seam and hence the length of each vent is 2 to 5 mms. Applied to bread and other leavened dough-based products a shelf-life of at least six weeks is normal, compared with a maximum of a week that is customary for these products when conventionally wrapped or left unwrapped in storage.

Substantial re-inoculation of the product in the container cannot long be delayed while the vents remain open and they should therefore be closed as soon as possible after cooling. The temperature to which the container should be cooled prior to closing the vents should be below that leading to deformation of the sealed container on cooling further to ambient temperature in storage.

Preferably two or more vents are provided, constituted by straight channels of constant cross-sectional area. These are preferably provided by interruptions in a closure seam of the container and may be produced by sealing a closure seam in the wall of the container over distance pieces of suitable cross-sectional area extending therethrough. Solid distance pieces must of course be withdrawn to provide the vents, but they may instead comprise open small-bore tubes which can remain, sealed in the seam, to provide the vents. The distance pieces whether solid or hollow may be tapered in section to facilitate their removal where this is required. Flat uniform strips are preferably about 1 mm thick. Preferably the packages are constituted by deep-drawn trays which may be made by thermo-forming synthetic resin films, over which a lid constituted by a second film is laid to abut the flat edges of the trays extending around the periphery of the trays from which the seams are made, over distance pieces laid across the edges of the trays. In this form the process is particularly suitable for mass production, continuous lines of the trays being filled, overlaid with the distance pieces and then the closure film and the seam thereafter being formed all round the trays and the distance pieces withdrawn before the trays are heated to decontaminate and, where applicable, part-bake the contents.

The trays may be returned to a sealing station which is again actuated in the absence of the distance pieces when the trays are cooled to complete the sealing of the package. This repeated operation provides enhanced security of sealing, first because much the greater area of the seal is exposed to repeated sealing action, usually by repetition of pressure and/or heat over the area of the seal, which may be provided by a coating responsive to these influences to afford adhesion between the adjacent parts of the sealing area. Second, the interruptions in the seal provided by the distance pieces are located in the seal and are therefore automatically located for sealing in the sealing station in the absence of the distance pieces. Third, the distance pieces used to provide the interruptions in the first formed seal are necessarily of limited profile if the actuating members of the sealing station are to accommodate them and seal them into the seam during the first operation of the sealing station on the package. The actuating members usually consist of cooperating elements providing a nip between which the seam is engaged, often also with the application of heat, to an adhesive layer between the areas of the package providing the seam. Thin distance pieces are therefore used to ensure that the initially-made seam is secure, laid flat between the elements of the seam, and by disturbing the profile of the seam as little as possible, ensure that the completed seam, made by subsequent operation at the sealing station with the distance pieces removed, is secure.

Conventional baking processes, operating at temperatures substantially in excess of 100° C., preferably 100° to 200° C. and more particularly 120° to 160° C., are sufficient to effect pasteurisation/sterilisation of the air-space and the surface of the dough product within a few minutes. Part-baking should be sufficient to confer rigidity to the product and prevent its collapse and to effect complete gelatinisation of starch content, at the same time ensuring that the action of the leavening is completed and arrested. Dough products which are intended to be kept fully baked should be baked at conventional temperatures to provide the requisite browning effect and may give up to 6 months shelf-life.

The invention may also be applied to packaged cooked products containing very little water originally to which additional water may be added. It is applicable in general to the packaging of cooked foodstuffs and other products liable to deteriorate by bacteriological contamination.

A wide range of film or foil material is available for the package. Laminated films, combining in their various layers different materials conferring particular properties, are preferred. In particular, an inner layer of polypropylene is preferred to provide a closure seam and improve watertight properties, since seals of this material are readily made by heat treatment which are resistant to dough-baking temperatures. A polyamide layer is also preferred for its heat stability and deep-drawing characteristics where these are employed, or a polyvinylidene chloride. A third layer of polyester confers additional strength and augments gas-tightness.

EXAMPLE

Transparent trays were made by deep-drawing from sheet 200×300 mm and 125 mμ thickness, leaving a flange 5 mm wide all round. The material consisted of a polyamide outer layer laminated to a polypropylene inner layer. Each tray was covered with a transparent lid 62 mμ thick, made from an outer polyester film laminated to a polypropylene inner film.

After filling with bun-sized pieces of risen bread dough, prepared according to a conventional recipe, each tray was heat-sealed all round its peripheral edges to the lid by forming a seam over straight, flat or round distance pieces of constant cross-sectional area laid across the seam between the elements thereof. On withdrawing these, channels of corresponding cross-section were formed, the seam being 2 to 5 mm wide.

The bread was part-baked in trays for a period of 40 to 60 minutes at 100° to 140° C. and thereafter the trays were allowed to cool by standing in a room at about 15° C., cooling to 50° C. taking about 20 minutes. The channels provided vents into the package interior.

It was found that with 8 channels there was no development of under-pressure in the resulting packages, whether the channels were of round or rectangular section, down to a cross-sectional area of as small as 1.0 $mm^2$. On the other hand, with only 1 channel it was difficult to avoid the development of under-pressure even with cross-sectional areas as great as 2.2 $mm^2$. Under-pressure was shown by partial package collapse.

A further batch of packaged part-baked dough was hermetically sealed over the channels as soon as cooling was completed.

The partly-baked dough in the sealed packages shows no visible signs of bacteriological spoilage after 3 months' storage at 15° C. The packages were then opened and the contents baked for a few minutes to produce a brown crust. A panel of taste experts pronounced the bread product to be of excellent quality and it was found to retain for several days the taste, texture and appearance of fresh bread.

What is claimed is:

1. A process for the preparation of baked or part-baked goods of improved shelf-life, the process comprising in combination the sequential steps of:

(a) packing dough pieces in a package constucted essentially from flexible film and comprising a tray furnished with flat edges of 2 to 5 mm in width extending about the periphery of the tray and a lid adapted to overlay the said tray and abut the said flat edges;

(b) providing non-tortuous straight vents between the lid and tray by placing two or more spacers each comprising flat non-tortuous straight strips about 1 mm thick with a cross sectional area less than 2.5 $mm^2$ laid flat between the abutting surfaces of the tray and lid to separate the tray and lid at spaced intervals around the periphery of the tray;

(c) sealing the abutting surfaces of the tray and lid together around the periphery of the tray to form a seam between the said spacers from 2 to 5 mm wide;

(d) withdrawing the spacers to provide interruptions in the seam constituting vents providing access to the interior of the package of at least 2.5 $mm^2$ total cross-sectional area and 2 to 5 mm in length, said vents permitting the package to be heated to baking temperatures without rupture and to be cooled without collapse;

(e) placing the package in a baking oven and exposing it to heat for a period of 40 to 60 minutes at 100° to 140° C.; and then (f) cooling the package and sealing said vents.

* * * * *